US006691926B1

(12) United States Patent
Moen

(10) Patent No.: US 6,691,926 B1
(45) Date of Patent: Feb. 17, 2004

(54) TURBO-FAN SNOW MAKING SYSTEM

(75) Inventor: Alan Moen, Redondo Beach, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/567,859

(22) Filed: May 9, 2000

(51) Int. Cl.[7] ..... F25C 3/04
(52) U.S. Cl. ..... 239/2.2; 239/14.1; 239/14.2
(58) Field of Search ..... 239/2.2, 14.1, 239/14.2

(56) References Cited

U.S. PATENT DOCUMENTS

| | | | | |
|---|---|---|---|---|
| 3,945,567 A | | 3/1976 | Rambach | |
| 4,010,613 A | | 3/1977 | McInerney | |
| 4,083,492 A | | 4/1978 | Dewey | |
| 4,427,074 A | * | 1/1984 | Wollin | 239/383 |
| 4,593,854 A | | 6/1986 | Albertsson | |
| 4,597,524 A | | 7/1986 | Albertsson | |
| 4,682,729 A | | 7/1987 | Doman et al. | |
| 4,813,598 A | | 3/1989 | Kosik, Sr. et al. | |
| 4,901,920 A | | 2/1990 | Wollin | |
| 5,937,654 A | | 8/1999 | Tunkel et al. | |
| 6,129,290 A | * | 10/2000 | Nikkanen | 239/14.2 |

FOREIGN PATENT DOCUMENTS

| | | |
|---|---|---|
| DE | 4131858 | 4/1993 |
| DE | 4423124 | 1/1996 |
| JP | 04116361 | 4/1992 |
| JP | 05296628 | 11/1993 |
| WO | 9963286 | 12/1999 |

* cited by examiner

*Primary Examiner*—Christopher Kim
(74) *Attorney, Agent, or Firm*—Oral Caglar, Esq.

(57) ABSTRACT

A snow making system comprises a cooling subsystem having a fan that draws a first air into the cooling subsystem and a turbine that expands a second air to produce an expanded air, with the cooling subsystem combining the first air and the expanded air to produce a high mass-flow, high-velocity, cooled air. A nozzle subsystem has a channel that receives the cooled air and a water injector that injects water into the cooled turbine air such that the water is atomized and frozen by the high-velocity cooled air. The system thereby produces frozen water nuclei in the absence of a nucleating nozzle. The remainder of the channel receives high-velocity, high mass-flow fan air and water injectors that inject water into said air such that water particles are partly atomized. The two flows then mix upon exiting the system and produce snow if ambient conditions permit. The snowmaking system has a tilting mechanism and optional drip shields that utilize gravity to prevent water from entering grooves/seals between rotating and non-rotating parts, where the potential to freeze and seize units exists. The snowmaking system also has an optional thawing/deicing subsystem comprising a vortex tube that expands air and generates a hot flow and cold flow. The hot flow is directed into the snowmaking machine housing and thereby warming the fan and nozzles and melting any accumulated ice/snow.

15 Claims, 6 Drawing Sheets

TURBO-FAN SNOW MAKING SYSTEM

BACKGROUND OF THE INVENTION

The present invention relates to a snow making system and, more particularly, to an apparatus and method that makes snow by a fan and turbine that produces a high-velocity cooled air that atomizes water, thereby creating a stream of frozen water seeds (nuclei) and a stream of small water particles, and blowing the mixed streams across a distance to freeze and form snow.

Snow making is critical to ski resorts. This is because the amount of snow and the length of time the snow is present dictate whether a resort has financially successful or unsuccessful season. Generally, as the amount of snow increases, so does the length of time the snow is present. The longer the length of time snow is present, the longer skiers are able to use a resort. However, unpredictable weather patterns can mean poor ski conditions and financial ruin to a ski resort.

Therefore, ski resorts have long recognized the need for snow making capability. However, snow making has been capital and labor intensive. Essentially, two different systems have been utilized to make snow—an airless system and an air (i.e., air/water) system. Typically, in an air/water system, a ski resort contains a central air compressor and water pumping center located near the base of the resort. From the center, air and water lines run along the ski slopes. At various points of the ski slopes, provision is made for tapping into the air and water lines. In an "airless" system, pressurized water lines and electrical lines (or other motorized means to power the snowmaking machine) are utilized to make snow.

One very early air/water system is simply a nozzle (i.e., snowgun) that combines high amounts of compressed air and relatively low amounts of pressurized water. The compressed air and pressurized water are simultaneously discharged from the snowgun. As the compressed air and pressurized water exit the snowgun, the expansion of air creates frozen nuclei, breaks up the water into small particles, and propels it across the slope. The cold, ambient air completes the process and causes the water to freeze into snow. However, the gun design produces relatively little snow despite the large amounts of air used. The high cost of producing the compressed air is the major drawback of this type of system.

In the airless systems, compressed air is used to a limited extent, if at all. Instead, a fan typically draws ambient air into the system housing. Downstream of the fan is an air-atomizing nozzle(s) that produces very small water particles (typically less than 50 microns) that immediately freeze to form ice nuclei (seeds), as well as water nozzles that produce water droplets. The ice nuclei and water droplets mix with the ambient air from the fan and are propelled across the slope, forming snow before it reaches the ground. Although more energy efficient than the compressed air systems, they suffer the capital cost disadvantage of having the need for a portable internal combustion engine accompanying the system or, in the alternative, an electrical distribution system across the ski slopes. They are also limited to making snow at temperatures at 26 degrees F. or colder. In addition, the large size (500+ lbs.) and complexity of these systems makes it difficult to move them (and virtually impossible with a snowmobile) and prohibits mounting on towers to take advantage of the efficiency of making snow from an elevated height.

A hybrid system employing features of both the air and airless systems is found in U.S. Pat. No. 3,945,567. Compressed air is used to drive a motor that, in turn, drives air-impeller blades. The blades draw in ambient air. Exhaust air from the motor is combined with compressed air and pressurized water to form a combined stream of very small water particles. The combined stream and the ambient air are mixed. After the mixed stream exits the apparatus, additional water is sprayed into the mixed stream, where it is thereupon converted into snow when ambient temperatures are 26 degrees F. or less. An advantage of this design is that the use of compressed air eliminates the need for electric or internal combustion motors in close proximity to the apparatus. However, disadvantages to this design include the relatively inefficient motor and, although the compressed air is relatively dry, the moisture in the air will condense out as the temperature drops and cause the motor to freeze up.

In another hybrid system, U.S. Pat. No. 4,593,854 provides a water driven turbine to drive a downstream fan to draw in ambient air. An annular air/water manifold ring is downstream of the fan. The air/water manifold supports nucleating (i.e., water atomizing) nozzles or nucleators and snowmaking nozzles positioned between the former. Air and water mixtures are discharged downstream and outside of the apparatus. A water manifold is concentric to and surrounds the air/water manifold, the former of which supports nucleating nozzles. The water manifold is not used in marginal snowmaking conditions. Some of the disadvantages to this design include: 1) any water remaining within the water turbine will freeze after shutdown and cause the turbine to freeze up, and even blowing out the system will most likely leave residual water; 2) water pressure varies greatly from the top and the bottom of the mountain (100 to 500 psi or greater), leaving little "power" at the top of the mountain; 3) nucleating/air atomizing nozzles tend to freeze up unless an external heat source is supplied. Commercially available electric-fan type snowmaking machines provide electric heaters to ensure this does not occur, but with a water-powered machine electricity is not available for this function.

U.S. Pat. No. 4,597,524 is similar to U.S. Pat. No. 4,593,854 and thus has similar disadvantages. Both are similar in that they use pressurized water to drive a fan, rather than compressed air as in U.S. Pat. No. 3,945,567. Specifically, in U.S. Pat. No. 4,597,524, air-water atomizing nozzles are positioned in the fan-induced air stream and within (or outside) a shroud that surrounds the fan. A water powered turbine drives the axial fan.

U.S. Pat. No. 4,682,729 also uses the nucleating nozzle, water droplet, fan concept of the airless system and is powered by compressed air. However, a reaction fan is used, in addition to the creation of separate zones of ice nuclei and water droplets. Compressed air is sent to the reaction fan which expands the compressed air and rotates the fan blades. The rotation of the fan blades draws in ambient air. Downstream of the reaction fan is the nucleating nozzle which is centrally disposed within the system housing. The nucleating nozzle combines the compressed air with water to expel ice nuclei into the drawn-in ambient air. Downstream of the nucleating nozzle and at the exit of the system are water nozzles that expel water droplets into the mixture of ice nuclei and drawn-in ambient air. Again, this design has the disadvantage of air-atomizing nozzle freeze up unless electrically heated. Also, this design has long slender tubing exposed to cold ambient air that will rapidly clog with ice that forms when water condenses out of the compressed air. Additionally, the efficiency of this system is questionable—the air/water operating ratio of 22:1 at 35 degrees F. is no better than existing air/water guns.

Additional references to snow making apparatus are found in U.S. Pat. Nos. 4,813,598 and 4,901,920.

As can be seen, there is a need for an apparatus for and method of making snow, particularly one that minimizes the need for expensive compressed air. Another need is to eliminate the provision of an electrical power distribution system, or an expensive, cumbersome internal combustion engine, to drive the snow making system. Also needed is a snow making apparatus and method that can be effectively used at higher ambient temperatures, thus increasing the number of environments in which the apparatus and method can be used. Another need is for a snow making apparatus that is not prone to freeze up during operation or shutdown without the benefit of electrical heaters. Yet a further need is for apparatus and a method of making snow to be lightweight and portable such that snow can be made on elevated structures to thereby gain efficiency/capacity, or sled mounted so that it can be easily moved from slope to slope by snowmobile.

SUMMARY OF THE INVENTION

In one aspect of the present invention, a snow making system comprises a cooling subsystem having (a) a fan that draws a first air into the cooling subsystem; and (b) a turbine that expands a second air to produce an expanded air; with the cooling subsystem combining the first air and the expanded air to produce a cooled air; and a nozzle subsystem having (a) a channel that receives the cooled air; and (b) a water injector that injects water into the cooled air such that the water is atomized by the cooled air; with the said system thereby producing frozen water in the absence of a nucleating nozzle.

In a second aspect of the invention, compressed air expanded across a turbine drives a relatively high pressure ratio fan (tip turbine fan) to effect an airflow multiplication in order to achieve a high mass-flow, high-velocity air stream, coupled with a low temperature, high-velocity air stream from the turbine. The high-velocity, low temperature (super-cooled) air from the turbine outlet is used to both break up a stream of small water particles (about 500–600 microns) into very small droplets (<100 microns) and instantly freezing the particles to form snowmaking seeds (nuclei). Additional nozzles inject small water particles (<1000 microns) into the high mass-flow, high-velocity air from the fan, thereby breaking up the water particles into smaller droplets (about 150–250 microns), thus eliminating the need for hydraulic atomizing nozzles and, due to the airflow multiplication, allowing for increased capacity. Mixing of the first stream of frozen nuclei with the second stream of air/water triggers snow formation in the combined flow as it is projected through ambient air.

A third aspect of the invention is anti-ice protection in the form of drip shields to keep water from entering and ice from forming in grooves/seals where it might stop the unit from rotating. The invention has the capability to angle down so that gravity forces water to flow over the drip shield and past grooves/seals that might cause freeze-up problems.

A fourth aspect of the invention is thawing capability to remove ice and snow that may build up on the snow making system. The thawing system comprises a vortex tube with compressed air source and a housing/shroud surrounding the snow making system. The vortex tube splits compressed air into a hot and a cold stream. The hot stream is directed to the housing/shroud so that the snow making system (while it is not in operation) is heated sufficiently to melt accumulated ice/snow. Additionally, this aspect of the invention may be used while the snow making machine is running in order to prevent ice from forming in critical locations.

These and other features, aspects, and advantages of the present invention will become better understood with reference to the following drawings, description and claims.

DETAILED DESCRIPTION OF THE INVENTION

Although the present invention is particularly useful in the context of a ski slope, the present invention is not so limited. Rather, the apparatus and method of the present invention can be used for snow making in general.

Figure 1:
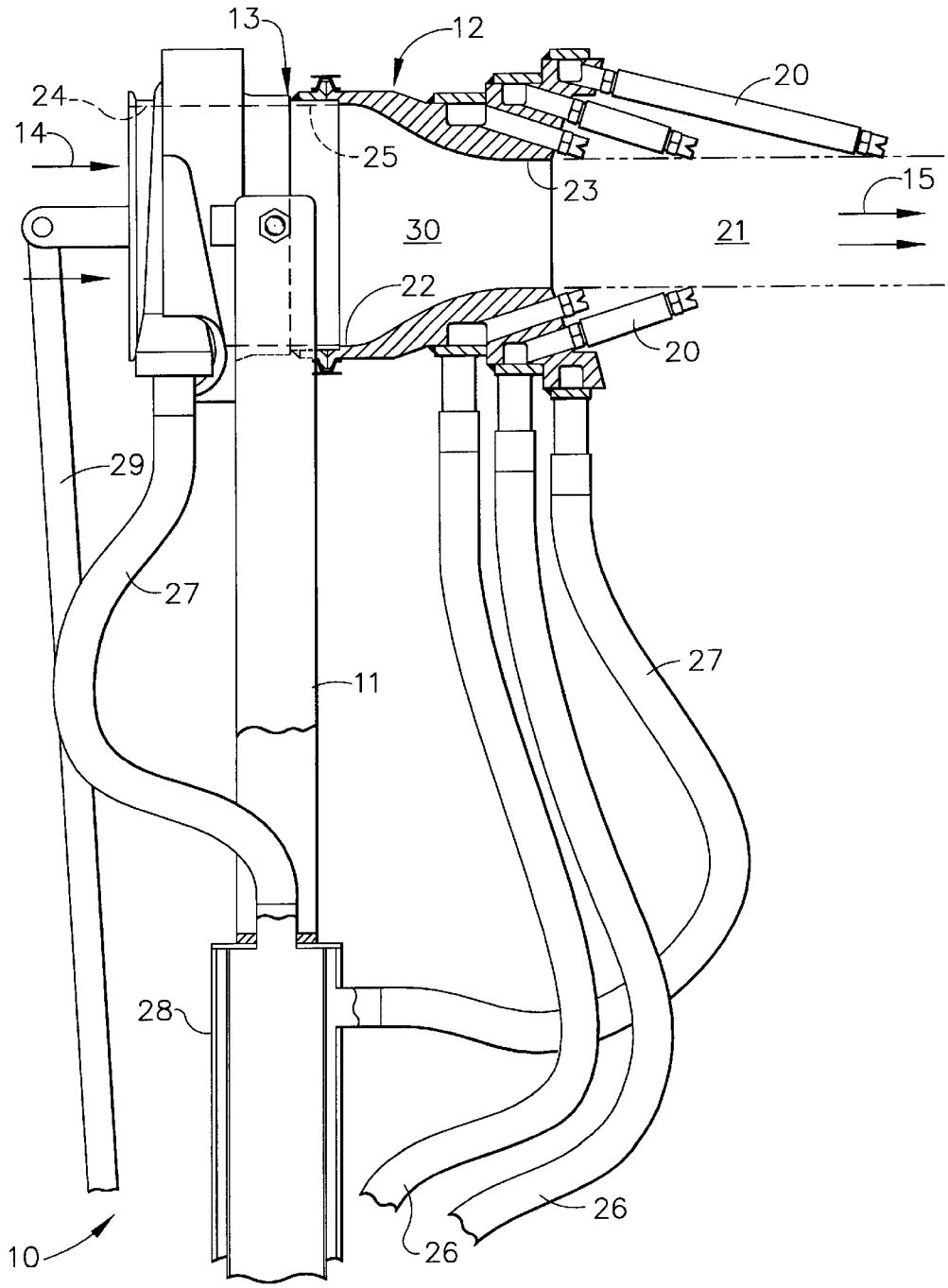
FIG. 1 is a side view of the snow making system according to an embodiment of the present invention.

FIG. 1 depicts a snow making system 10 generally having a support structure 11, a nozzle subsystem 12, a cooling subsystem 13, a compressed air source (not shown), and a pressurized liquid or water source (not shown). The snow making system 10 is particularly adaptable for use on a ski slope that has an already existing compressed air source and pressurized water source. With such existing sources, compressed air lines and pressurized water lines will already exist in a network about the ski slopes. Thereby, the snow making system 10 can utilize the existing compressed air and pressurized water lines. Alternatively, portable compressed air and pressurized water sources may be provided in connection with the system 10.

Figure 2:
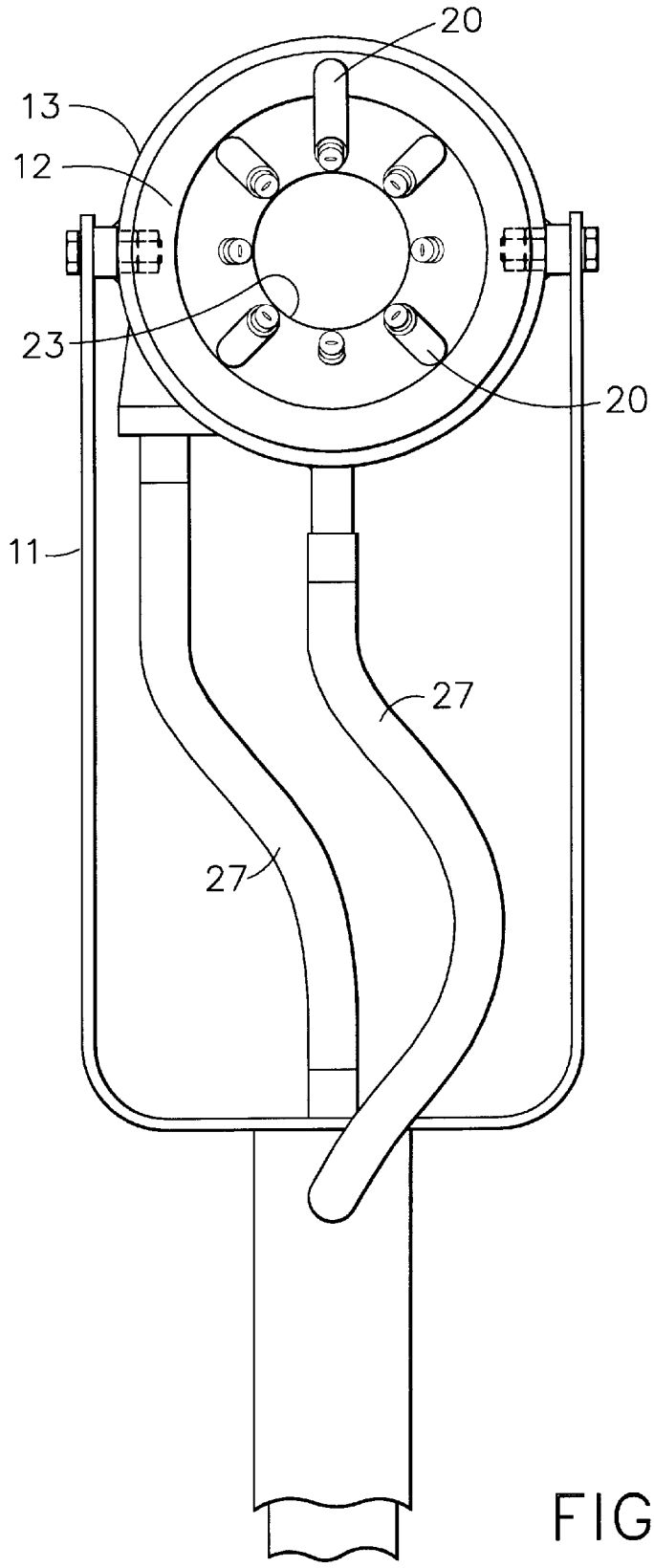
FIG. 2 is a front view of the snow making system according to an embodiment of the present invention.

As seen in FIGS. 1 and 2, the support structure 11 supports the nozzle and cooling subsystems 12, 13. The support structure 11 is shown as a U-shaped frame on top of a pole. The U-shaped frame is affixed to the cooling subsystem 12 such that the subsystem 12 (and thereby the cooling subsystem 13) can rotate about a horizontal axis when actuated by an actuator 29. Preferably, the U-shaped frame can also rotate about the longitudinal axis of the pole. With the two degrees of rotation, the subsystems 12, 13 can be positioned to cover with snow areas within 360° of and at various radii from the support 11.

The snow making system 10 can be conceptually divided into a first subsystem and a second subsystem. The first subsystem would include the cooling subsystem, while the second subsystem would include the nozzle subsystem and optionally an area exterior of the nozzle subsystem.

Figure 3:
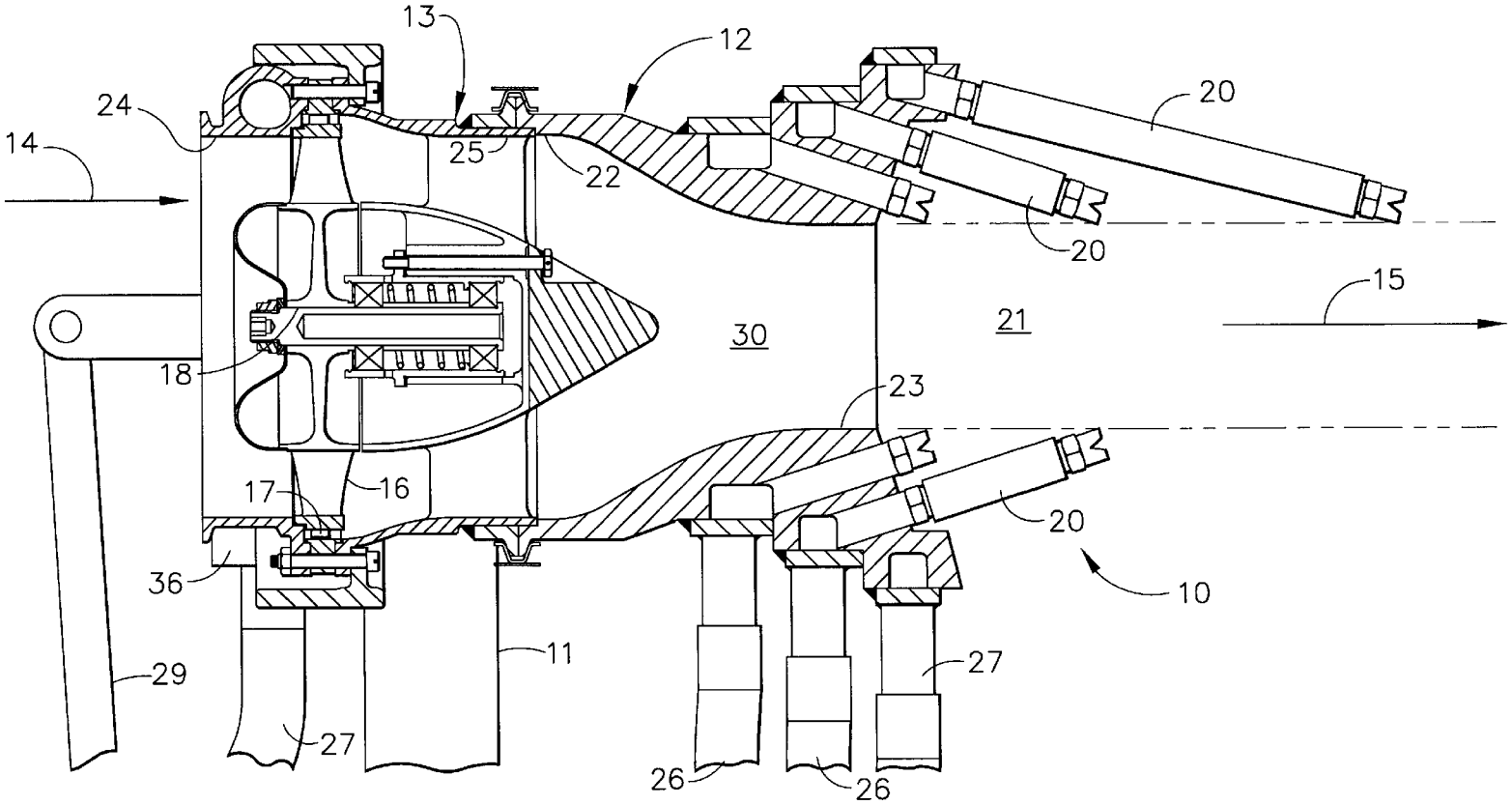
FIG. 3 is a side, cross-sectional view of the snow making system according to an embodiment of the present invention.

In one embodiment of the invention, as shown in FIG. 3, the cooling subsystem 13 is generally cylindrically shaped and includes a subsystem inlet 24 at one end and a subsystem outlet 25 at an opposite end. The inlet end 24 allows an ambient air 14 to be drawn into the cooling subsystem 13 upon the rotation of axial fan blades 16 (which is sometimes referred to herein as simply a fan). The fan blades 16 can be of any well-known design. The temperature of the ambient air 14 can vary, but is typically about −20 to 30° F. for practicing the present invention. The fan 16 is rotated, on shaft 18, by an expansion turbine 17, such as an axial tip turbine or radial in-flow turbine. Both types of turbines are of well-known designs, such as that respectively manufactured by Honeywell Engines and Systems and Honeywell Automotive as used on the M1A1 tank and various aircraft and truck applications.

The expansion turbine 17 is, in turn, rotated by compressed air, via an air line 27, from the compressed air source (not shown). By way of example, the compressed air source may provide about 70–110 psi air @ 14 lbs/min @ 35° F. Irrespective of the specific characteristics, the compressed air from the air line 27 is fed into an air ring 36 that supports turbine air nozzles 19 (FIG. 4) of the cooling subsystem 13. The turbine air nozzles 19 communicate the compressed air to the turbine 17 and thereby provide power to rotate fan 16. Upon the compressed air passing across the turbine 17, the compressed air is expanded to produce an expanded air that is lower in temperature than the compressed air. Preferably, the expanded air is at a temperature between about −60 to −65° F.

Figure 4:
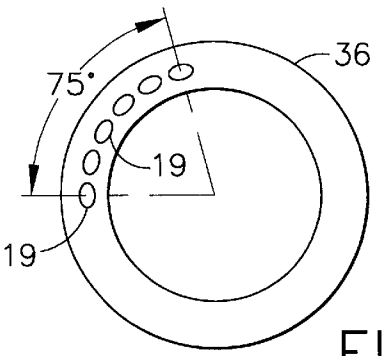
FIG. 4 is a front view showing an exit pattern of a partial emission, air ring with turbine air nozzles in one embodiment of the present invention.

The expanded air from the turbine 17 is then mixed, preferably only partially as described below, with the ambient air 14 drawn into the cooling subsystem 13. Upon such mixing, the temperature of the air 14 is lowered and the temperature of the expanded air is raised. A cooled air is thereby produced at a temperature between that of the ambient air 14 and the expanded air. The extent of mixing (i.e., partial or full) and cooling depends on the nozzle exit design of the air ring 36 and turbine air nozzles 19. As seen in FIG. 4, for partial mixing, the turbine air nozzles 19 span a partial circumferential area of the air ring 36. As an example, the air nozzles 19 can span a 75° angular zone. Full mixing of the expanded air from the turbine 17 with the ambient air 14 from the fan 16 could include turbine air nozzles 19 spanning the entirety of the circumference of the air ring 36. With full mixing about the entirety of the air ring 36 (or just in the 75° angular zone), a mixed temperature of −3.4 degrees F. is produced. No mixing of the expanded turbine air and the ambient air 14 (e.g., outside of the 75° angular zone) leaves the expanded turbine air temperature undiluted at −63 degrees F. Whether fully mixed or if no mixing occurs, the effective cooling capacity of the turbine exhaust is enough to freeze about 0.29 gallons of water per minute. This yields a nucleator water flow from at least one of a plurality of liquid injectors 20 described below to main water flow from the remaining liquid injectors 20 of about 345:1 to 58:1 over the design range of the invention. The 58:1 ratio at warm conditions (i.e., about 26 to 30° F.) allows for nearly double the frozen nuclei per unit water of electric fan systems (i.e., about 100:1) and is a primary reason this invention can generate snow in warmer temperatures.

Irrespective of the mixing of ambient air 14 and expanded air, the cooled air is propelled by the motive force of the drawn-in ambient air 14 and expanded air to exit the cooling subsystem 13 at the outlet 25. The cooled air then enters the nozzle subsystem 12.

The nozzle subsystem 12 is also cylindrical in configuration and has at one end a nozzle inlet 22 that interfaces the subsystem outlet 25 and at the opposite end a nozzle outlet 23. The nozzle subsystem 12 includes a channel 30 that allows the cooled air from the cooling subsystem 13 to move through the nozzle subsystem 12 and exit in the form of a column. As shown in FIG. 3, the channel 30 has a converging configuration from the nozzle inlet 22 and towards the nozzle outlet 23. In such a configuration, the channel 30 is in the form of reduced cross-sectional area whereby the velocity of the cooled air is accelerated and the back pressure of the fan 16 is optimized. A preferred speed of the cooled air at the nozzle outlet 23 is between about 300 to 350 mph at a temperature of about −20 to 30° F.

Figure 5:
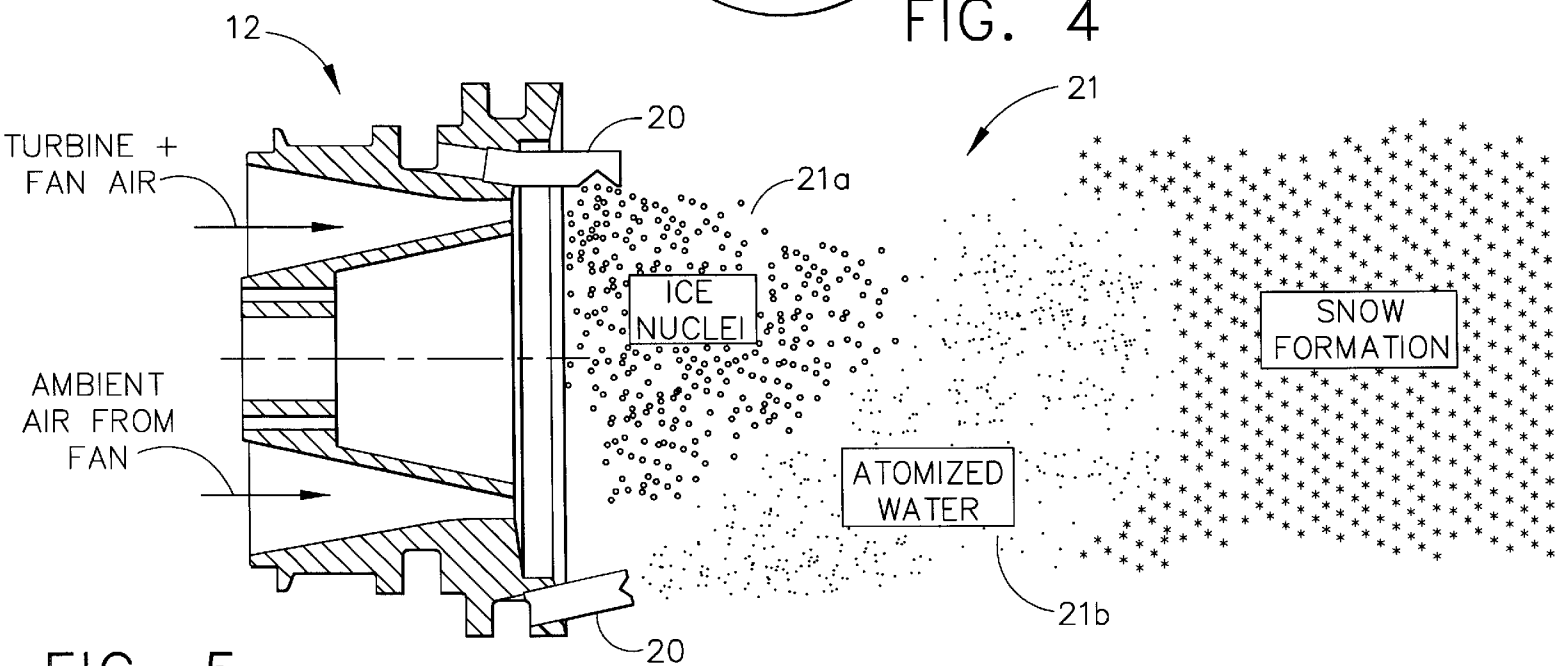
FIG. 5 is a side, cross-sectional view of a second embodiment of a nozzle subsystem of the present invention.

An alternate design for the nozzle subsystem 12 is shown in FIG. 5. In FIG. 5, the fan flow is kept as a circular ring or donut of air, rather than being funneled down to a column of air (as in shown in the embodiment of FIG. 3). Keeping the air as a ring isolates the expanded air from the turbine 17, which exits from a 75-degree zone of the air ring 36 (FIG. 4), from the majority of the fan air 14 and minimizes mixing of expanded turbine air with fan air 14. In the embodiment of FIG. 5, the channel 30 still has a converging cross-section area to achieve the desired back pressure and velocity. However, in this alternative embodiment, the increase in circumference (when compared to the above embodiment) of the exiting air stream allows for improved atomization of water particles at the expense of the throw distance. Nevertheless, the present invention also contemplates that the channel 30 need not have a converging configuration. Other configurations of the channel 30 can also be used.

In referring again to the embodiment of FIG. 3, surrounding the channel 30 and at the exterior of the nozzle subsystem 12 are a plurality of liquid injectors 20. As better shown in FIG. 2, the injectors 20 are circumferentially positioned proximate to the nozzle outlet 23. While FIGS. 2 and 3 depict five injectors 20 at particular circumferential positions, the number and positions of the injectors 20 can vary. The function of the injectors 20 is to inject or expel liquid (and preferably water) from outside of an atomization area 21 and into the atomization area 21 exteriorly of the nozzle subsystem 12 in this embodiment. The injectors 20 are fed from the pressurized liquid source (not shown) via liquid lines 26. As an example, the liquid or water may be supplied at about 100 to 1000 psi water at 10 to 100 gal/min at 33° F.

Preferably, the injectors inject the liquid or water in the form of a spray. The injectors 20 are accordingly of well-known design, such as that manufactured by Spraying Systems, Inc. under the trade name V-Jet. The injectors 20 are preferably arranged so that the liquid droplets are introduced around the circumference of the atomization area 21. In so doing, the concentration of liquid droplets in the atomization area 21 is more evenly distributed so as to optimize the use of high-velocity air flow and results in greater snow production efficiency. Preferably, at least one of the injectors 20 produces the nucleator water flow mentioned above and that has water particles of about 500–600 microns. The remaining injectors 20 preferably produce the main water flow mentioned above and that has water particles of about 800 to 1000 microns.

In the atomization area 21 (as better shown in FIG. 5) the cooled air from the turbine 17 and fan 16 contacts the liquid droplets from the injectors 20. Preferably, the nucleator water flow contacts the mixed turbine air and fan air to produce liquid droplets of about 30 to 60 microns. Thereby, ice nuclei or seeds are produced in an ice nuclei area 21*a* of the atomization area 21. At the same time, the main water flow preferably contacts the fan air to produce liquid droplets of about 150 to 250 microns in an atomized water area 21*b* of the atomization area 21.

With the cooled air preferably moving at a speed between about 300 to 350 mph and the droplets in the nucleator water flow preferably moving at about a 85 to 95 (and more preferably at a 90) degree angle to the cooled air, a relative velocity of about 300 to 350 mph between air and water droplet is produced. The relative velocity between air and water droplet is important as it limits the maximum droplet size. Droplet size is a primary concern in snowmaking, with smaller droplets having more surface area and, hence, cool faster. Smaller droplets also take longer to fall to the ground, allowing more time to freeze. Existing electric snow making machines have nucleating nozzles that create water particles in a range of 40 to 60 microns, and hydraulic nozzles that generate 150 to 200 micron water droplets.

Per NASA Technical Report 32-987 dated Jul. 1, 1968 and incorporated herein by reference, drop breakup criteria state that drop diameter is limited to a value D for which $We=\rho_g*V^2_s*D/2\sigma=6$. Weber number of 6. Thus, $$D\max=12\sigma/\rho_g*V^2_s$$

where $\sigma$=surface tension (0.0047965 slugs/sec$^2$ for water); $\rho_g$=gas density (0.00234 slugs/ft$^3$ for air); V=slip velocity (velocity air—velocity water, 350 to 450 ft/sec at 90 degrees). In the nucleating section 21*a* of the atomizing section 21, with the water injectors 20 at 90 degrees relative to the air flow, the maximum droplet size is about 36.8 to 60 microns. In the remainder of the atomizing section 21 the maximum droplet size is about 193 to 223 microns for this embodiment of the invention.

Hence, it can be seen, the contact between the liquid droplets and the cooled turbine air, which exits in a 75-degree angular zone of the 360-degree circumference, atomizes and freezes the droplets. Accordingly, the present invention eliminates the need for nucleators or nucleating nozzles used in prior designs to produce atomized water. While the embodiment shown in FIGS. 1, 3, and 5 depict the atomization area 21 exteriorly of the nozzle subsystem 12 (specifically, exterior to the channel 30), the present invention contemplates that the atomization area 21 can be interior of the nozzle subsystem 12, such as in the channel 30. In such instance, the injectors 20 would be positioned to inject liquid into the channel 30.

Regardless of the position of the atomization area 21, frozen liquid in the form of seeds or nuclei is produced in the atomization area 21 along with partly atomized water particles. These ice seeds or nuclei, together with small water droplets, exit the atomization area 21 due to the motive force of the cooled air and form snow 15 upon mixing with the ambient air.

Figure 6:
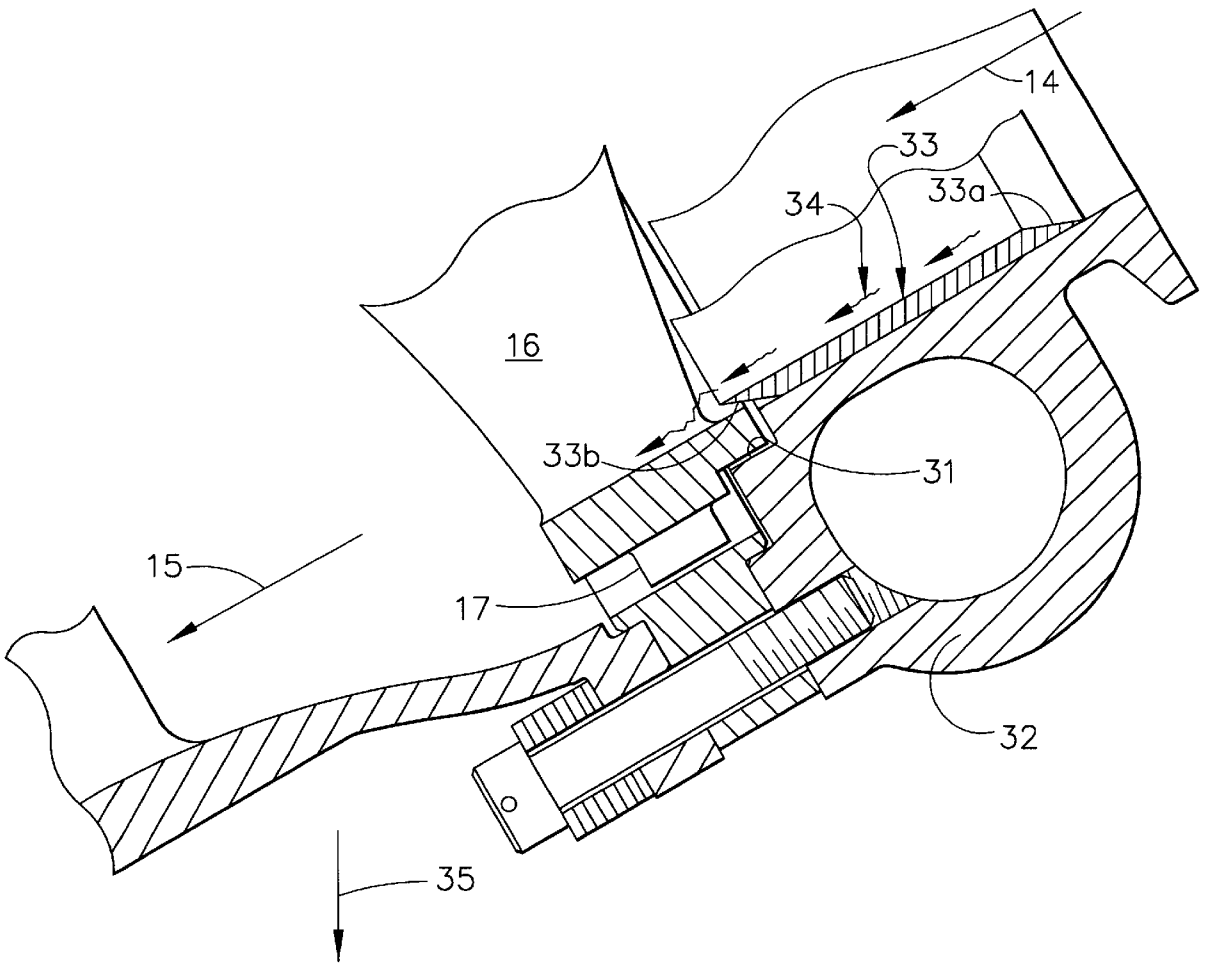
FIG. 6 is a portion of a side, cross-sectional view of the snow making system showing an ice prevention aspect according to an embodiment of the present invention.

As discussed above, the system 10 can rotate about a horizontal axis. A secondary function of allowing for vertical movement of the system 10 is to prevent ice from forming at a void space or seal/slot 31 between the fan/turbine 16, 17 and a fan housing 32 that encloses the fan/turbine 16, 17 (FIG. 6). A drip shield 33 is a circular ring element that is disposed over at least a portion of the seal/slot 31. The shield 33 has a first sloping edge 33*a* that causes water 34 to run across the top of the shield 33 as the water 34 runs downward from gravity 35, as shown in FIG. 6. A second sloping edge 33*b* of the shield 33 is proximate to the seal/slot 31 and causes the water 34 to pass over the seal/slot 31. The shield 33 is incorporated into the housing 32 such that during shutdown with the fan blades 16 angled downward (as shown in FIG. 6) water 34 from rain or melting snow cannot run into the seal/slot 31 and freeze/refreeze during colder temperatures. Thereby, ice is prevented from seizing the system 10.

Figure 7:
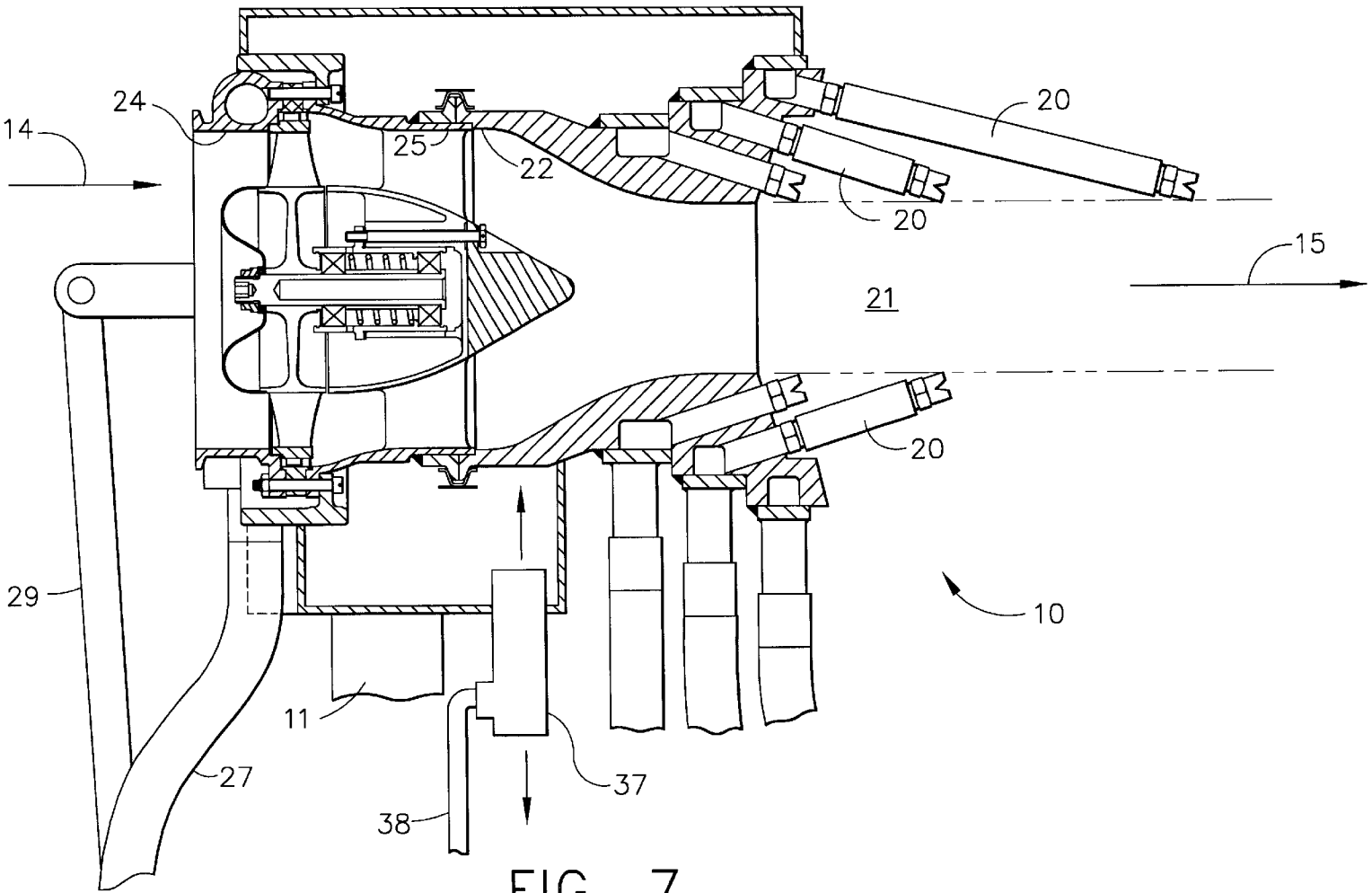
FIG. 7 is a side, cross-sectional view of the snow making system showing a thawing subsystem according to an embodiment of the present invention.

FIG. 7 shows a thawing/deicing subsystem comprising a vortex tube 37, an air supply line 38, a housing 39, and a valve (not shown). Upon opening the valve, the vortex tube 37, commercially available by Exair Corp., Cincinnati Ohio, expands the 70 to 110 psi supply air in the supply air in the supply line 38. The air is directed tangentially into the vortex spin chamber of the tube 37 where it revolves up to 1,000,000 rpm. The resulting vortex splits the air into two streams, generating a hot flow and a cold flow. The hot flow, up to about +260° F., is directed into the snowmaking machine housing 39 which encloses at least the cooling subsystem 13, and preferably the nozzle subsystem 12 as well. Thereby, the turbine blades 17 and air nozzles 19 are warmed above 32 degrees F to melt any accumulated ice/snow.

In view of the above, it can be seen that the present invention also provides a method of making snow. The method generally includes driving a first air from fan blades with a second air from a turbine, effectively multiplying the airflow. A high-mass flow, high-velocity cooled air is produced from the first air (i.e., ambient air) and second air (i.e., low-mass, high-pressure, low temperature turbine air or super cooled turbine air). The next step includes atomizing a liquid by contacting the liquid with the high mass-flow, high-velocity cooled air, freezing nuclei with super-cooled turbine air, and then producing a frozen liquid (i.e., snow) upon the mass of air, water particles, and frozen nuclei being propelled across ambient air.

In more specific aspects of the present invention, the method includes placing the turbine downstream of the fan blades and expanding a compressed air by the turbine. Further steps include reducing a temperature of the first air, as well as raising a temperature of the second air. Thereafter, the method includes mixing the liquid and cooled air in an atomization area. Also, the cooled air may be accelerated prior to the step of atomizing. In one embodiment, the first air comprises an ambient air, the second air comprises an expanded air, and the liquid comprises water.

EXAMPLE

For purposes of comparison, the performances of a prior art electric fan system (such as the WizzKid made by Snow Machines Incorporated (SMI) of Bay City, Mich.) and the present invention were theoretically calculated in ambient air at 28° F., water temperature of 33° F., water pressure at 200 psi, and air pressure at 115 psi at 35° F. The pressure rise across the fan in both systems was 1.02, and the throw and spread of snow of each system was assumed equal. In order for the throw and spread to be equal, the momentum of the water/air stream and the ratio of water to air, at the nozzle/fan exit, must be equal. Given such assumed equality, the performance of each system was judged by the temperature of the exit air flow stream.

For the electric fan system, the temperature of the air stream is as follows:

$$\Delta T\ \text{fan}=5.2\times PR/\text{density}\times Cp\times 778\ (\text{a constant to balance units})\times \text{Efficiency Fan}\times\text{Efficiency Motor}$$

wherein PR (pressure rise across the fan) of 1.02 is converted into inches of water (1 psi=27.7 in $H_2O$), Cp (specific heat at constant pressure) is 0.24 for air, density (at sea level, in lb/cu-ft) is 0.0765 for air. Efficiency Fan is assumed to be 80%, and Efficiency Motor is assumed to be 80%. Therefore, $$\Delta T\ \text{fan}=5.2\times 8.14/0.0765\times 0.24\times 778\times 0.80\times 0.80=+4.63^\circ\ \text{F. (above ambient)}$$

$$\text{Exit Air Stream Temp}=\text{Ambient Temp}+\Delta T\ \text{fan}=28^\circ\ \text{F.}+4.63^\circ\ \text{F.}=32.63^\circ\ \text{F.}$$

For the present invention, the exit air stream temperature is a combination of the temperature and mass of the fan flow with the temperature and mass of the turbine flow, as follows:

$$\Delta T \text{ fan}=5.2\times PR/\text{density}\times Cp\times 778\times \text{Efficiency Fan}$$

Efficiency of the fan was 69%. Since there is no motor, motor efficiency does not enter into the equation.

$$\Delta T \text{ fan}=5.2\times 8.14/0.0765\times 0.24\times 778\times 0.69 =+4.29^\circ \text{ F. (above ambient)}$$

However, with the presence of a turbine, the following is considered:

$$\Delta T \text{ turbine}=T_{In}\ (Y/Y+1)\times \text{Efficiency Turbine}$$

wherein $Y=PR^{283}-1$, PR (pressure drop across turbine) is 115/15 or 7.67, Efficiency Turbine is 45%, and $T_{In}$ is in degrees Rankine (35° F.+460)=495° R. Thus, $$\Delta T \text{ turbine}=495^\circ \text{ R}\times 0.438\times 0.45=-97.6^\circ \text{ F. (below supply temperature)}$$

For a tip turbine fan to achieve power balance, the mass flow of the turbine is 3.65 lbs/min vs. the fan flow of 68.8 lbs/min. Therefore, $$\text{Exit Air Stream Temp}=(((W_{turb}\times T_{turb}\ (^\circ\text{R}))+(W_{fan}\times T_{fan}))/W_{tot})-460$$

wherein $T_{turb}$ equals −62.6° F. (35° F. −97.6° F.) or 397.4° R, $T_{fan}$ equals 32.29° F. (28° F. +4.29° F.) or 492.3° R, and $W_{tot}$ equals total mass flow of 72.45. Thus, $$\text{Exit Air Stream Temp}=(((3.65\times 397.4)+(68.8\times 492.3))/72.45)-460=27.5^\circ \text{ F.}$$

The above indicates that the present invention decreases the exit temperature by 0.5° F. below ambient, whereas the prior art electric driven fan increases the exit temperature to 4.92° F. above ambient. The increase in temperature makes it difficult for snow to be made by the prior art system at ambient temperatures above 27° F. On the other hand, the present invention allows snow to be made at ambient temperatures closer to 32° F.

A prototype of the present invention incorporating the embodiment shown in FIGS. 3 and 4 was tested by making snow at 28° F. with the relative humidity (RH) at 65% (equivalent Wet Bulb=26° F.). One V-Jet nozzle was spraying into the turbine outlet cold zone, resulting in an air/water ratio of 12:1. Snow quality was very dry. When ambient conditions increased above 28° F., the snowmaking facility was shut down because the existing snowmaking machines (HKD Snow Towers) could not make quality snow even though the prototype invention continued to make dry snow.

A second prototype of the invention incorporated the embodiment of FIGS. 1, 2, 3, 4, and 6, and a water nozzle arrangement incorporating several rings and valves so as to vary the water flow. Snow was successfully made at 34° F., RH 26 (25.5° F. Wet Bulb). Air/water ratio was 6:1. Snow quality was acceptable. Existing snow making equipment (snow guns) were operating at a less efficient (more expensive) 15:1 air/water ratio.

It can also be appreciated that the present invention minimizes the need for expensive compressed air compared to air/water guns, using 50% to 80% less, depending on conditions. It also eliminates the provision of a portable, electrical power source, such as an internal combustion engine, to drive the snow making system. By it being useable at higher ambient temperatures, the number of environments in which the apparatus and method can be used is increased. The present invention is also lightweight (40 lbs. as opposed to 500+ lbs. for same capacity electric system)such that snow can be made on elevated structures to thereby increase the area covered by the snow and gaining 25% or more in snowmaking capacity, and/or portable so that it may be mounted on a sled and pulled by snowmobiles.

Also, through the use of super-cooled, high-velocity turbine exhaust and perpendicularly aligned, ice and clog resistant nozzles to atomize and freeze water into nuclei, the need for freeze-prone or electrically-heated air-atomizing (nucleating) nozzles is eliminated. And by the use of drip shields and other features, the possibility of freeze-ups has been eliminated.

It should be understood, of course, that the foregoing relates to preferred embodiments of the invention and that modifications may be made without departing from the spirit and scope of the invention as set forth in the following claims.

I claim:

1. A snow making system, comprising:

a first subsystem that combines a first air from a first air source with a second air from a turbine to produce a cooled air, said turbine being an expansion turbine having fan blades rotated by compressed air being fed through turbine air nozzles from an air ring which receives said compressed air from a compressed air source; and a second subsystem that accelerates said cooled air and introduces a liquid into contact with said cooled air, wherein a relative velocity between said cooled air and said liquid is between approximately 300 mph and approximately 350 mph, and thereby atomizes said liquid upon said cooled air contacting said liquid and produces a frozen liquid.

2. The system of claim 1, wherein said first air comprises an ambient air.

3. The system of claim 1, wherein said second air comprises an expanded air.

4. The system of claim 1, wherein said first subsystem includes:

a fan; and said turbine, wherein expanded air from said turbine is mixed with ambient air from said fan downstream of said turbine and said fan.

5. The system of claim 4, wherein said turbine is an air expansion turbine.

6. The system of claim 1, wherein said liquid comprises water.

7. The system of claim 1, wherein said second subsystem includes:

an atomization area; and a liquid injector that communicates said liquid from outside of said atomization area and to said atomization area.

8. The system of claim 1, further comprising:

a compressed air source in communication with said first subsystem; and a liquid source in communication with said second subsystem.

9. A snow making system comprising:

a cooling subsystem including a turbine for expanding compressed air and providing a first air stream, the turbine further driving a fan to provide an airflow multiplication of an ambient air to achieve a second air stream, the cooling subsystem combining the first air stream and the second air stream to provide an output air stream having a velocity of approximately 300 to 350 miles per hour, said turbine being an expansion turbine having fan blades rotated by compressed air being fed through turbine air nozzles from an air ring which receives said compressed air from a compressed air source;

a nozzle subsystem including a channel for receiving the output air stream and a water injector for injecting water particles of approximately 500–600 microns into the output air stream in an atomization area proximate the nozzle subsystem to provide for nucleation of the injected water particles, said channel having a converging configuration from an inlet to an outlet of said nozzle subsystem, thereby creating a back pressure on said fan in said cooling subsystem; and a plurality of water injectors for injecting water particles of approximately 800–1000 microns into the output air stream in the atomization area to provide for atomized water particles.

10. The system of claim 9, wherein said super-cooled airstream further comprises an airflow having a velocity of approximately 300 to 350 mph relative to the injected water particles of approximately 500–600 microns.

11. The system of claim 9, wherein the nucleated water particles further comprise particles of approximately 30 to 60 microns.

12. The system of claim 9, wherein the atomized water particles further comprise particles of approximately 150 to 250 microns.

13. A snow making system comprising:

a first subsystem that combines a first air source with a second air from a turbine to produce a cooled air;

an air ring in said first subsystem receiving compressed air from a compressed air source;

a plurality of air nozzles communicating said air ring with said turbine thereby driving said turbine;

a second subsystem that accelerates said cooled air toward a nozzle outlet and into an atomization area;

at least one liquid injector located proximal to said nozzle outlet providing a first water flow having water particles of about 500–600 microns into said atomization area;

a plurality of additional liquid injectors located distal to said nozzle outlet providing a second water flow having water particles of about 800–1000 microns into said atomization area;

said cooled air passing through said atomization area at a velocity of approximately 300 to 350 miles per hour;

said velocity causing said first water flow to atomize to water particles of about 30 to 60 microns; and said velocity causing said second water flow to atomize to water particles of about 150 to 250 microns.

14. The snow making system according to claim 13, wherein said at least one liquid injector provides said first water flow at an angle of about 85 to about 95 degrees relative to a direction of movement of said cooled air.

15. The snow making system according to claim 13, wherein said plurality of additional liquid injectors provides said second water flow at an angle of 20 to 90 degrees relative to a direction of movement of said cooled air.

* * * * *